US006189650B1

(12) United States Patent
Inuzuka et al.

(10) Patent No.: US 6,189,650 B1
(45) Date of Patent: Feb. 20, 2001

(54) MUFFLER STRUCTURE

(75) Inventors: Kazuhiro Inuzuka; Kunihiko Fujiwara; Kazunari Ohno, all of Okazaki (JP)

(73) Assignee: Futaba Industrial Co., Ltd., Okazaki (JP)

( * ) Notice: Under 35 U.S.C. 154(b), the term of this patent shall be extended for 0 days.

(21) Appl. No.: 09/379,293

(22) Filed: Aug. 23, 1999

(51) Int. Cl.[7] ..... F01N 1/00
(52) U.S. Cl. ..... 181/254; 181/265; 181/272
(58) Field of Search ..... 181/237, 241, 181/253, 254, 264, 269, 272, 278, 265

(56) References Cited

U.S. PATENT DOCUMENTS 3,783,590 * 1/1974 Allen ..... 181/230
5,739,483 * 4/1998 Yashiro et al. ..... 181/254
5,866,860 * 2/1999 Chen ..... 181/237

FOREIGN PATENT DOCUMENTS 5-42624 6/1993 (JP) .

* cited by examiner

*Primary Examiner*—Khanh Dang
(74) *Attorney, Agent, or Firm*—Davis and Bujold

(57) ABSTRACT

There is disclosed a muffler structure in which a valve opened/closed in accordance with exhaust gas pressure in a pipe is prevented from chattering by an inlet pipe provided with a first side hole and an outlet pipe provided with a second side hole with a valve biased by a spring to simultaneously close both the first and second side holes when the pressure is relatively low. When the pressure of the exhaust gas is relatively high, the pressure exerted on the valve by the exhaust gas in the inlet pipe is sufficient to open the valve and the exhaust gas introduced to the inlet pipe flows out to a second chamber via the first side hole, flows into the outlet pipe via the second side hole, and is exhausted to the outside of the muffler via the downstream outlet opening.

7 Claims, 8 Drawing Sheets

MUFFLER STRUCTURE

BACKGROUND OF THE INVENTION (i) Field of the Invention

The present invention relates to a muffler structure in which at least one pipe is disposed in a muffler.

(ii) Description of the Related Art

A muffler structure has been heretofore known in which an exhaust gas flow path inside a muffler is changed in accordance with an engine operation state in order to reduce back pressure during high-rate rotation of an internal combustion engine.

For example, in a muffler disclosed in Japanese Utility Model Application Laid-Open No.5-42624, as shown in FIG. 8, an inner pipe 103 is provided with a pivotably supported valve 105. In the valve 105, a pressure receiving portion 105*a* is formed opposite to a downstream end of an inlet pipe 101, while a closing portion 105*b* is formed opposite to an upstream end of an inner pipe 103.

In the muffler, when engine exhaust gas has a relatively low pressure, the inner pipe 103 is closed by the closing portion 105*b* of the valve 105 via the biasing force of a spring 108. Therefore, exhaust gas introduced via the inlet pipe 101 is passed through another inner pipe 104 and exhausted to the outside via an outlet pipe 102.

On the other hand, when the pressure of the engine exhaust gas is relatively high, the exhaust gas introduced via the inlet pipe 101 exerts force against the pressure receiving portion 105*a* of the valve 105, and opens the valve 105 against the biasing force of the spring 108, whereby the closing portion 105*b* of the valve 105 opens the upstream end of the inner pipe 103. Therefore, the exhaust gas introduced via the inlet pipe 101 passes through the inner pipe 103 in addition to the inner pipe 104, and the back pressure can be inhibited from rising.

However, when the muffler structure of FIG. 8 is used, exhaust gas exerts pressure on the pressure receiving portion 105*a* of the valve 105 from a substantially orthogonal direction. As a result, when pulsation is generated in the exhaust gas, a cracking or chattering noise may be generated by the contact of the valve 105 in the downstream end of the inlet pipe 101 and the upstream end of the inner pipe 103.

Moreover, when the pressure of the exhaust gas is high, the increase of back pressure is prevented by opening the valve 105 to pass the exhaust gas through the inner pipe 103. However, in some muffler designs, the increase of the back pressure cannot sufficiently be prevented simply by increasing gas path area.

Furthermore, in accordance with the length of the outlet pipe 102, when the number of revolutions of the engine reaches or exceeds a certain value, sound pressure level rapidly increases by columnar resonance. Such a problem cannot be solved by the muffler structure of FIG. 8.

SUMMARY OF THE INVENTION

An object of the present invention is to provide a muffler structure which inhibits a valve, opened/closed in accordance with pressure inside a pipe, from chattering.

Another object of the present invention is to prevent back pressure from increasing beyond a desirable magnitude.

A further object of the present invention is to suppress columnar resonance.

To attain these and other objects, according to one aspect of the present invention there is provided a muffler structure in which one or more pipes are disposed in a muffler. The muffler structure is provided with a side hole formed in a side surface of the at least one of these pipes, and a valve for opening or closing the side hole in accordance with a pressure of gas passing through the pipe having the side hole.

In the muffler structure, when engine exhaust gas passes through the pipe provided with the side hole, and exhaust gas pressure is low, the side hole remains closed by the valve. On the other hand, when the pressure of the exhaust gas is high, the valve is pushed open by the pressure, and the side hole is opened. Therefore, the exhaust gas passing through the pipe flows to the outside from the side hole. In this case, different from a case where the side hole is closed, the resistance is reduced, and the back pressure is inhibited from rising.

Furthermore, since a direction in which the exhaust gas flows is substantially parallel with a face of the valve closing the side hole, there is only a small possibility that chattering occurs, even if pulsation is caused in the pressure of the exhaust gas. Therefore, according to the muffler structure, abnormal noise is effectively prevented from being generated by chattering.

According to another aspect of the present invention there is provided a muffler structure in which first and second pipes are arranged in a muffler, and exhaust gas passes through the second pipe via the first pipe. The muffler structure is provided with a first side hole formed in a side surface of the first pipe, a second side hole formed in a side surface of the second pipe, and a valve for opening or closing both the first and second side holes in accordance with a pressure of the gas passing through the first pipe.

In such a muffler structure, when the pressure of engine exhaust gas is low, both the first and second side holes are closed by the valve. Therefore, for example, when the second pipe has an introductory inlet other than the second side hole, the exhaust gas flows out of an opening on the downstream side of the first pipe, then enters the second pipe via the introductory inlet. Moreover, when the second pipe has no introductory inlet except the second side hole, the exhaust gas flows out of the opening on the downstream side of the first pipe, then takes another route without passing through the second pipe.

On the other hand, when the pressure of the engine exhaust gas is high, the first and second side holes are both opened by the valve. Therefore, when the exhaust gas passes through the first and second pipes, it goes out of the first side hole before reaching the opening on the downstream side of the first pipe, then enters the second pipe via the second side hole. Specifically, a new route which can be taken by the exhaust gas is formed.

Therefore, according to the muffler structure, when the pressure of the exhaust gas is increased, a new route through which the exhaust gas can pass is formed, so that when the exhaust gas passes through the muffler, the resistance is remarkably reduced, and the rising of the back pressure can sufficiently be inhibited.

Here, it is preferred that the first side hole should be provided in the vicinity of the upstream end of the first pipe, while the second side hole should be provided in the vicinity of the downstream end of the second pipe. In this case, for the newly formed route, since a passing distance between the pipes is shortened, the rising of the back pressure can further effectively be suppressed.

Moreover, an outlet pipe may be used as the second pipe. In general, the outlet pipe has a problem, in accordance with its length, that when the number of revolutions of the engine reaches a certain value or more, the sound pressure level is abruptly raised by columnar resonance. In the present invention, however, when the number of revolutions of the engine is increased, the pressure of the exhaust gas is raised, and a new route through which the exhaust gas can pass is formed. Therefore, the above-mentioned problem can be prevented from arising.

In this case, the first and second pipes are preferably inlet and outlet pipes, respectively. For example, the first and second pipes may be upstream and downstream inner pipes, respectively. In this case, however, the new route is formed between the inner pipes. On the other hand, when the first and second pipes are inlet and outlet pipes, respectively, the new route is formed between the inlet and outlet pipes. Therefore, immediately after the exhaust gas is introduced into the muffler, it is exhausted to the outside of the muffler. The rising of the back pressure can effectively be suppressed further.

Additionally, in the present invention, when the pipe is disposed in the muffler, it may be disposed entirely or partly in the muffler.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
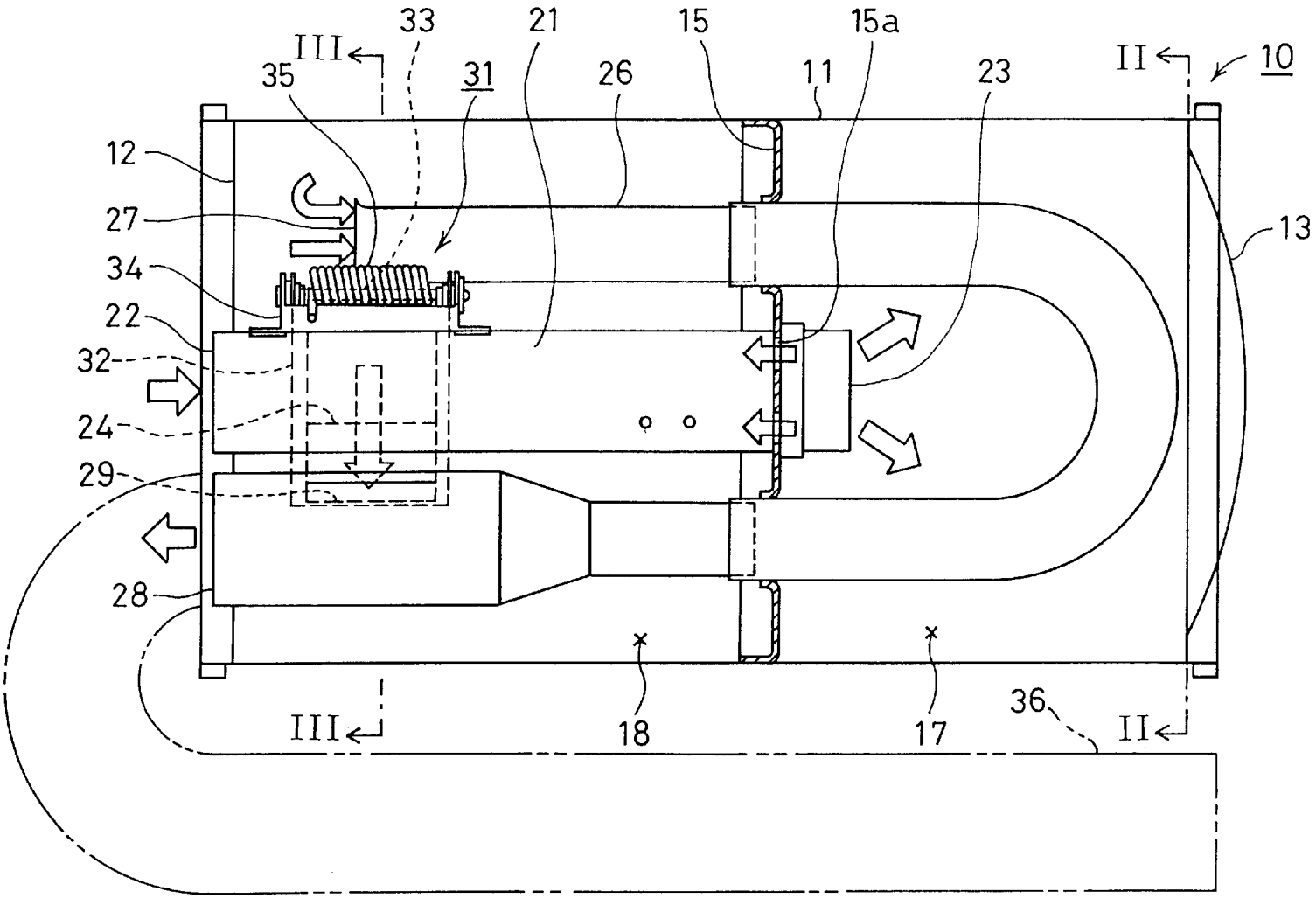
FIG. 1 is a sectional diagrammatic view showing a muffler structure according to a first embodiment of the present invention.
Figure 2:
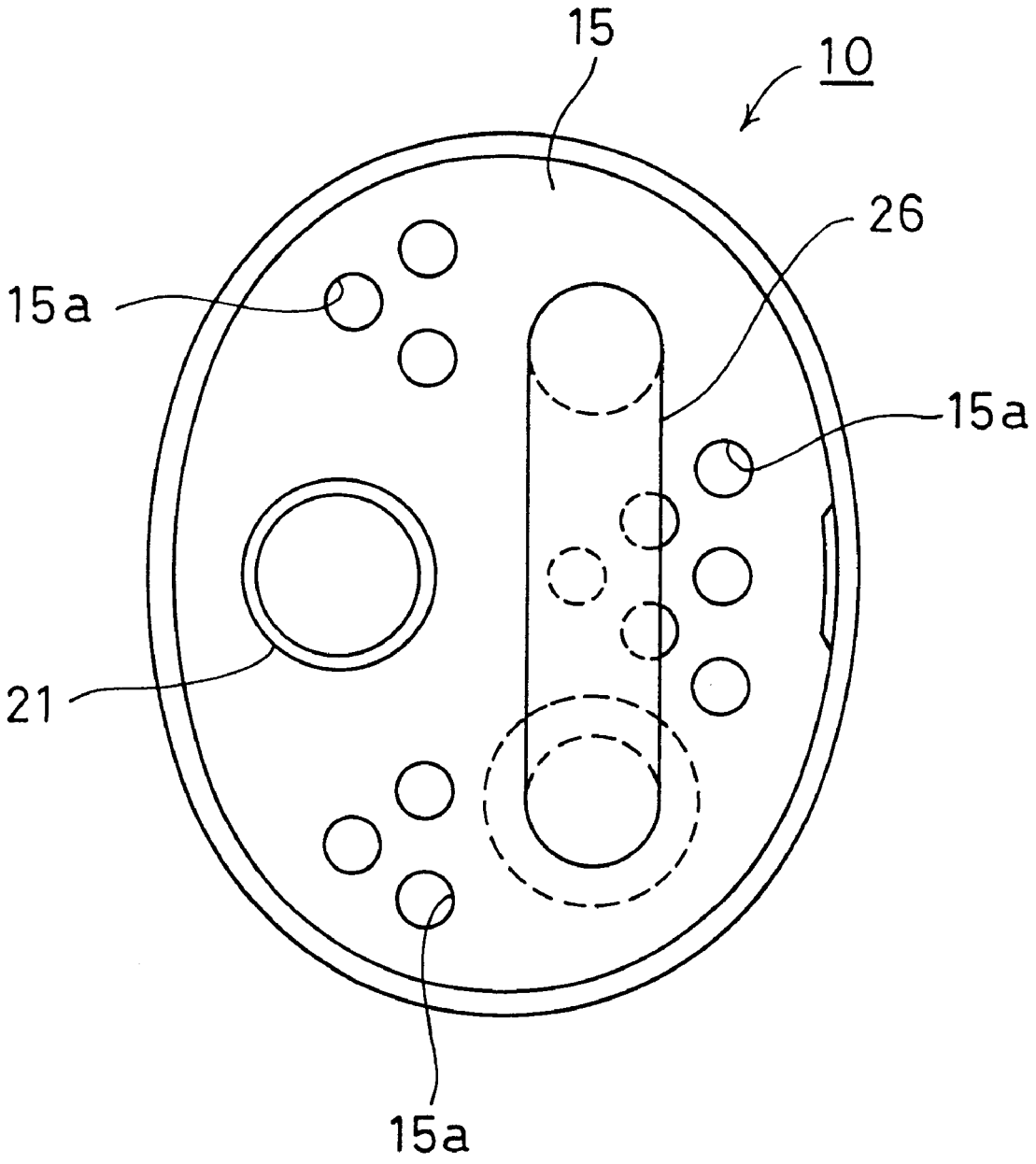
FIG. 2 is a sectional view taken along line II—II of FIG. 1.

Preferred embodiments of the present invention will now be described with reference to the accompanying drawings. Additionally, the present invention is not limited to the following embodiments and, needless to say, can be embodied variously within the technical scope of the present invention.

First Embodiment

In the first embodiment, a muffler 10 is provided with a housing with both ends of a cylindrical outer wall 11 closed by front-end and rear-end walls 12 and 13. The inside of the housing is divided, into two separate chambers, by a partition wall 15 having a plurality of punched holes 15*a*. The chambers are a first or upstream chamber 17, defined by the rear-end wall 13, partition wall 15 and outer wall 11, and a second or downstream chamber 18 defined by the front-end wall 12, partition wall 15 and outer wall 11.

An inlet pipe 21 and outlet pipe 26 are arranged inside the muffler 10. For the inlet pipe 21, an upstream inlet opening 22 connected to an exhaust pipe of an engine (not shown) is formed in the front-end wall 12, and a downstream outlet opening 23 is disposed in the first chamber 17. The inlet pipe 21 is provided in such a manner that it passes into the first chamber 17 through the partition wall 15 from the second chamber 18.

Figure 3:
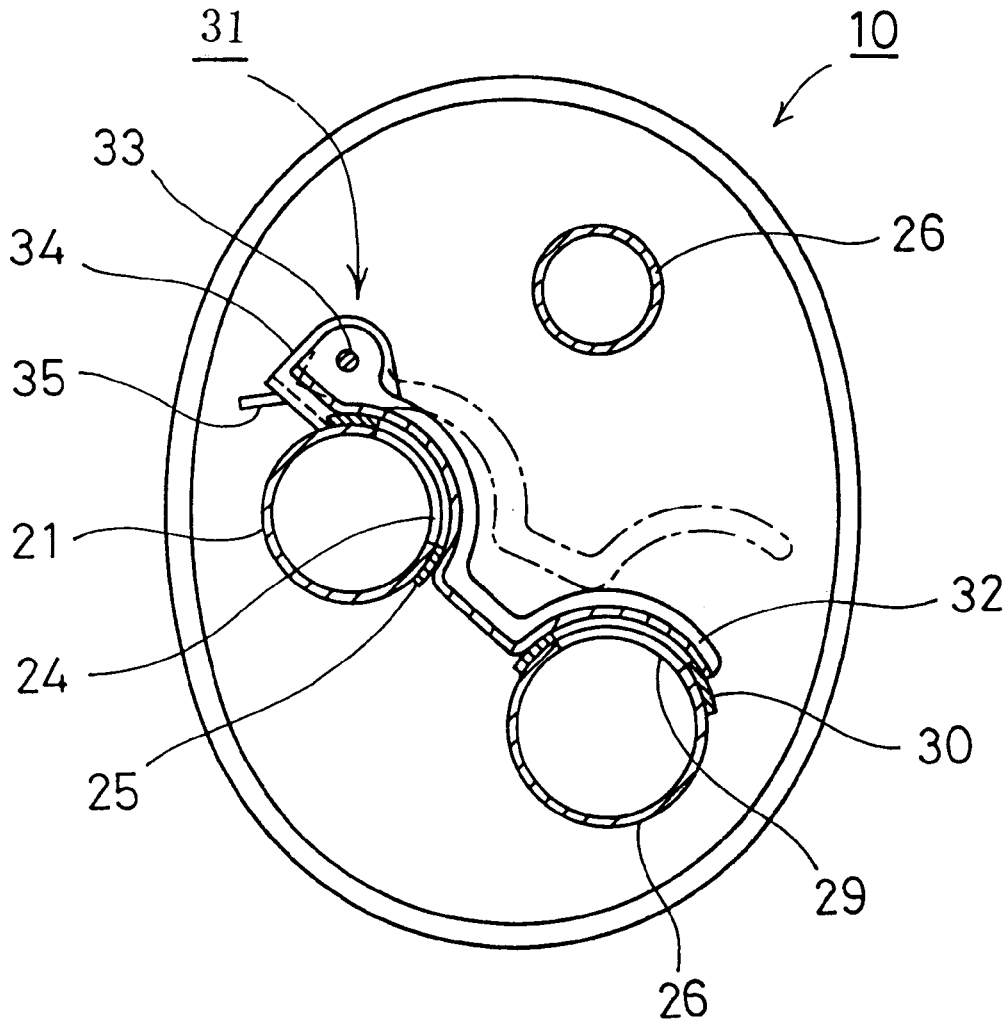
FIG. 3 is a sectional view taken along line III—III of FIG. 1.

In the vicinity of the upstream inlet opening 22, a square opening or first side hole 24 is formed in the side surface of the inlet pipe 21 opening into the second chamber 18. As shown in FIG. 3, a first wire mesh 25 is disposed as a cushion material around the first side hole 24.

For the outlet pipe 26, formed substantially in a U-shape, an upstream inlet opening 27 is disposed in the second chamber 18, while a downstream outlet opening 28 is disposed in the front-end wall 12. The outlet pipe 26 passes into the first chamber 17 through the partition wall 15 from the second chamber 18 and again passes through the partition wall 15 from first chambers 17 to the second chamber 18 and is the connected to the outside of the muffler.

Pipes 21 and 26 extend through partition wall 15 in a leak tight manner.

In the vicinity of the downstream outlet opening 28, a square opening or second side hole 29 is formed in the side surface of the outlet pipe 26 opening into the second chamber 18. As shown in FIG. 3, a second wire mesh 30 is disposed as a cushion material around the second side hole 29. Additionally, as shown in FIG. 1, in the outlet pipe 26, the portion provided with the second side hole 29 has an enlarged pipe diameter relative to the remainder of the outlet pipe 26. Moreover, the downstream outlet opening 28 of the outlet pipe 26 is connected to a tail pipe 36 formed substantially in a J-shape.

The inlet pipe 21 is provided with a valve assembly 31. The valve assembly 31 has a valve 32 which is configured to close both the first and second side holes 24 and 29, a stay 34 pivotably supporting the valve 32 via a support shaft 33, and a coil torsion spring 35 as a biasing member passed around the support shaft 33 to bias the valve 32 in a closed direction. As shown in FIG. 3, as the valve 32 closes the first and second side holes 24, 29 via the first and second wire meshes 25, 30, no collision noise is generated at the time of closing as this noise is damped by the mesh thereof.

The operation of the muffler 10 of the first embodiment will next be described.

When the exhaust gas from the engine has a relatively low pressure, the sum of the biasing force exerted on the valve 32 by the spring 35 and the force exerted on the valve 32 by the exhaust gas in the second chamber 18 is higher than an action force exerted on the valve 32 by the exhaust gas passing through the inlet pipe 21 and, therefore, the first and second side holes 24 and 29 remain closed by the valve 32.

In this case, as shown by solid-line arrows in FIG. 1, the exhaust gas introduced into the inlet pipe 21 via the upstream inlet opening 22 of the inlet pipe 21 flows into the first chamber 17 via the downstream outlet opening 23 of the inlet pipe 21. Subsequently, after the exhaust gas flows to the second chamber 18 via the plurality of holes 15*a* formed in the partition wall 15 from the first chamber 17, it is introduced to the upstream inlet opening 27 of the outlet pipe 26 to pass through the outlet pipe 26, to be exhausted to the outside of the muffler 10 via the downstream outlet opening 28. In this case, since the first and second side holes 24 and 29 remain closed and exhaust noise is sufficiently eliminated with an acceptable exhaust sound.

On the other hand, when the pressure of the exhaust gas from the engine is relatively high, the force exerted on the valve 32 by the exhaust gas passing through the inlet pipe 21 is higher than the sum of the biasing force exerted on the valve 32 by the spring 35 and the force exerted on the valve 32 by the exhaust gas in the second chamber 18. Therefore, as shown by a dashed line in FIG. 3, the valve 32 opens both the first and second side holes 24 and 29. In this case, the surface of the valve 32 covering the first side hole 24 is substantially parallel with the flow direction of the exhaust gas and, even if pulsation is caused in the exhaust gas, the valve 32 does not chatter.

When the valve 32 is open, in addition to the above-mentioned route shown by the solid-line arrows in FIG. 1, a short path is formed as a new route as shown by a dotted-line arrow in FIG. 1 and the exhaust gas introduced into the inlet pipe 21 via the upstream inlet opening 22 of the inlet pipe 21 flows to the second chamber 18 via the first side hole 24, then flows into the outlet pipe 26 via the second side hole 29, and is then exhausted to the outside of the muffler 10 via the downstream outlet opening 28 of the outlet pipe 26.

In this case, the first side hole 24 is provided in the vicinity of the upstream inlet opening 22 of the inlet pipe 21, while the second side hole 29 is provided in the vicinity of the downstream outlet opening 28 of the outlet pipe 26. In this case, the exhaust gas passing through the short path is introduced into the inlet pipe 21, and it immediately flows into the outlet pipe 26 via the second chamber 18. Subsequently, the exhaust gas is exhausted to the outside of the muffler 10 via the downstream outlet opening 28. The exhaust gas exhausted to the outside of the muffler 10 via the short route results in suppression of any back pressure increase of the exhaust gas. Moreover, since in the outlet pipe 26 the portion provided with the second side hole 29 has an enlarged pipe diameter, any increase of the back pressure is further suppressed. Consequently, any adverse influence on engine output or the like by an increase in back pressure is substantially eliminated.

Additionally, in the first embodiment, in order to form the first side hole 24 in the vicinity of the upstream inlet opening 22 of the inlet pipe 21 and form the second side hole 29 in the vicinity of the downstream outlet opening 28 of the outlet pipe 26, the upstream inlet opening 22 of the inlet pipe 21 and the downstream outlet opening 28 of the outlet pipe 26 are both provided in the front-end wall 12 of the muffler 10.

Figure 4:
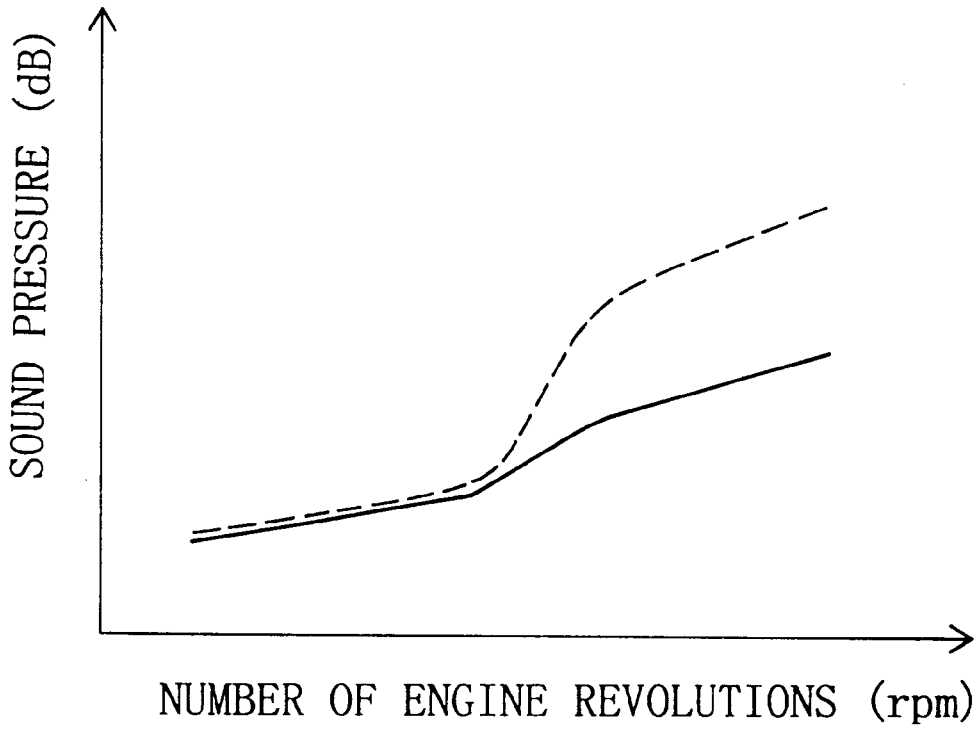
FIG. 4 is a graph showing a relationship of the number of revolutions of an engine and sound pressure level.

As shown by a dashed line in FIG. 4, the outlet pipe 26 has a problem that when the number of engine revolutions exceeds a certain value, the sound pressure level is raised. In the first embodiment, however, when the number of engine revolutions is increased, the pressure of the exhaust gas is raised and the valve 32 opens both the first and second side holes 24 and 29 to form the above-mentioned short path and the characteristics shown by a solid line in FIG. 4 are obtained to provide the advantageous operation of the present invention.

Second Embodiment

Figure 5:
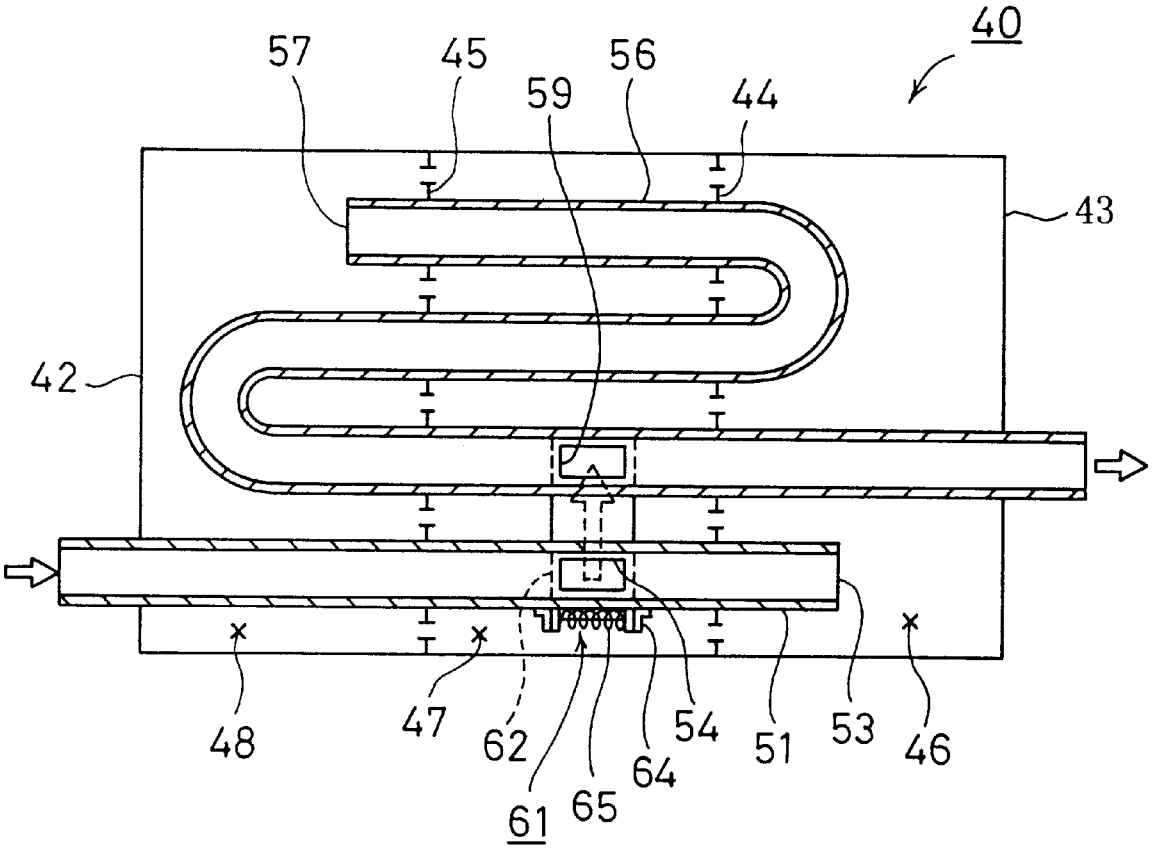
FIG. 5 is a sectional diagrammatic view showing a muffler structure according to a second embodiment.

FIG. 5 is a sectional view diagrammatically showing a muffler structure according to a second embodiment.

In the second embodiment, a muffler 40 is divided into a first or upstream chamber 46, second or middle chamber 47 and third or downstream chamber 48 by first and second partition walls 44, 45 having a plurality of punched holes therethrough.

An inlet pipe 51 is inserted through a front-end wall 42, second partition wall 45 and first partition wall 44, so that a downstream outlet opening 53 is positioned in the first chamber 46. A side surface of the inlet pipe 51 positioned in the second chamber 47 is provided with a first side hole 54.

An outlet pipe 56 formed substantially in a Z-shape has an upstream inlet opening 57 in the third chamber 48. The outlet pipe 56 then extends through the second and first partition walls 45, 44, turned in the first chamber 46, again extends through the first and second partition walls 44, 45, turned in the third chamber 48, and further extends through the second and first partition walls 45, 44 and a rear-end wall 43. The side surface of the outlet pipe 56 positioned in the second chamber 47 is provided with a second side hole 59 aligned with the first side hole 54.

The inlet pipe 51 is provided with a valve assembly 61. In the same manner as the valve assembly 31 of the first embodiment, the valve assembly 61 has a valve 62 which can simultaneously open or close both the first and second side holes 54 and 59, a stay 64, and a coil spring 65. The valve 62 is constantly biased to a closed position by the coil spring 65.

The operation of the muffler 40 of the second embodiment will next be described.

When the pressure of the exhaust gas from the engine is low, the valve 62 closes the first and second side holes 54 and 59. Therefore, the exhaust gas flows into the first chamber 46 via the downstream outlet opening 53 of the inlet pipe 51, flows out to the second chamber 47 via the punched holes of the first partition wall 44, further flows out to the third chamber 48 via the punched holes of the second partition wall 45, and is then exhausted to the outside of the muffler 40 through the outlet pipe 56.

On the other hand, when the pressure of the exhaust gas from the engine is high, the valve 62 opens both the first and second side holes 54 and 59 to form a short path as a new route (as shown by a dashed line arrow of FIG. 5). Here, the surface of the valve 62 covering the first side hole 54 is substantially parallel with the flow direction of the exhaust gas. Therefore, even if pulsation is caused in the exhaust gas, the valve 62 does not chatter. Moreover, since the exhaust gas can pass through the short path, increases in the back pressure are suppressed, to effectively prevent the generation of columnar resonance in the outlet pipe from arising.

Third Embodiment

Figure 6:
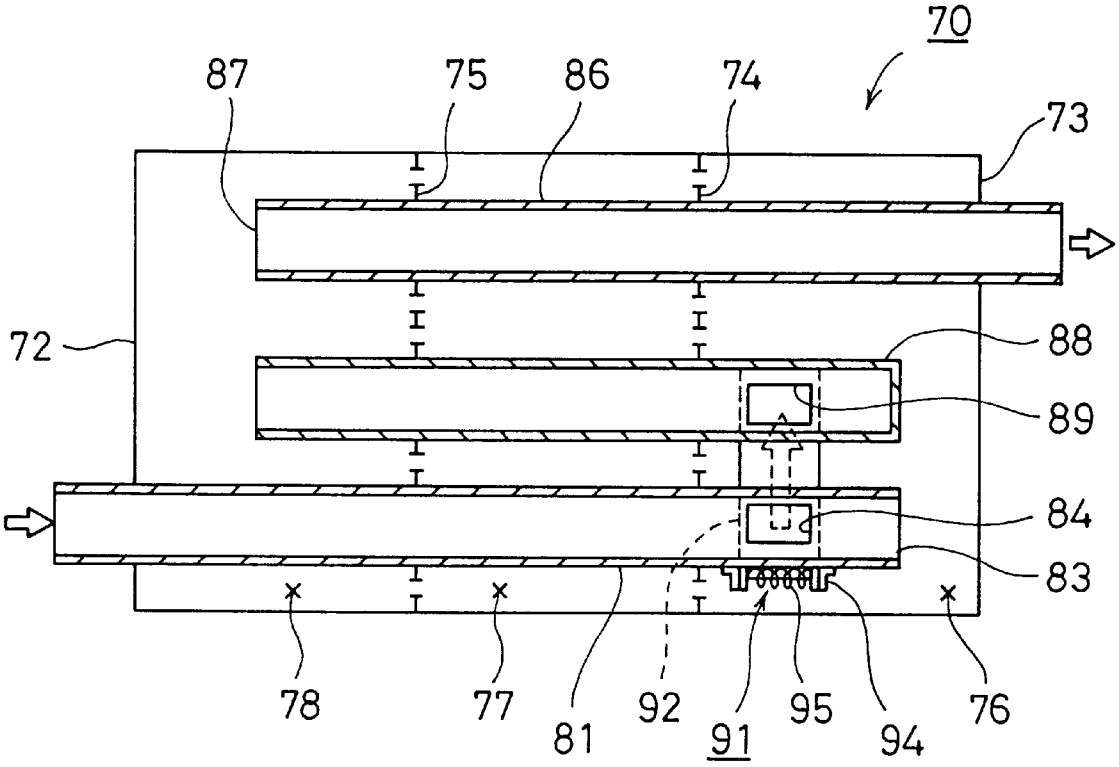
FIG. 6 is a sectional diagrammatic view showing a muffler structure according to a third embodiment.

FIG. 6 is a sectional view diagrammatically showing a muffler structure according to a third embodiment.

In the third embodiment, a muffler 70 is divided into a first upstream chamber 76, second or middle chamber 77 and third downstream chamber 78 by first and second partition walls 74, having a plurality of punched holes therethrough.

An inlet pipe 81 is inserted through a front-end wall 72, second partition wall 75 and first partition wall 74, so that a downstream outlet opening 83 is positioned in the first chamber 76. A side surface of the inlet pipe 81 positioned in the first chamber 76 is provided with a first side hole 84.

An outlet pipe 86 has an upstream inlet opening 87 in the third chamber 78. The outlet pipe 86 then extends through the second and first partition walls 75, 74 and a rear-end wall 73.

An inner pipe 88 extends from the first chamber 76 through the first and second partition walls 74, 75 to the third chamber 78. An end of the inner pipe 88 in the first chamber 76 is closed and a side surface of the inner pipe 88 positioned in the first chamber 76 is provided with a second side hole 89 aligned with the first side hole 84.

The inlet pipe 81 is provided with a valve assembly 91. In the same manner as the valve assembly 31 of the first embodiment, the valve assembly 91 has a valve 92 which can simultaneously open or close both the first and second side holes 84 and 89, a stay 94, and a coil spring 95. The valve 92 is constantly biased to a closed position by the coil spring 95.

The operation of the muffler 70 of the third embodiment will next be described.

When the pressure of the exhaust gas from the engine is low, the valve 92 closes the first and second side holes 84 and 89. Therefore, the exhaust gas flows into the first chamber 76 via the downstream outlet opening 83 of the inlet pipe 81, flows out to the second chamber 77 via the punched holes of the first partition wall 74, further flows out to the third chamber 78 via the punched holes of the second partition wall 75, and is then exhausted to the outside of the muffler 70 through the outlet pipe 86.

On the other hand, when the pressure of the exhaust gas from the engine is high, the valve 92 opens both the first and second side holes 84 and 89 to form a new route (as shown by a dashed line arrow of FIG. 6), which leads to the third chamber 78 through the inner pipe 88 from the first chamber 76. In this case, the surface of the valve 92 covering the first side hole 84 is substantially parallel with the flow direction of the exhaust gas. and even if pulsation is caused in the exhaust gas, the valve 92 is effectively inhibited from chattering. Moreover, since the exhaust gas can pass through the new route, increases in the back pressure are effectively suppressed.

Fourth Embodiment

Figure 7:
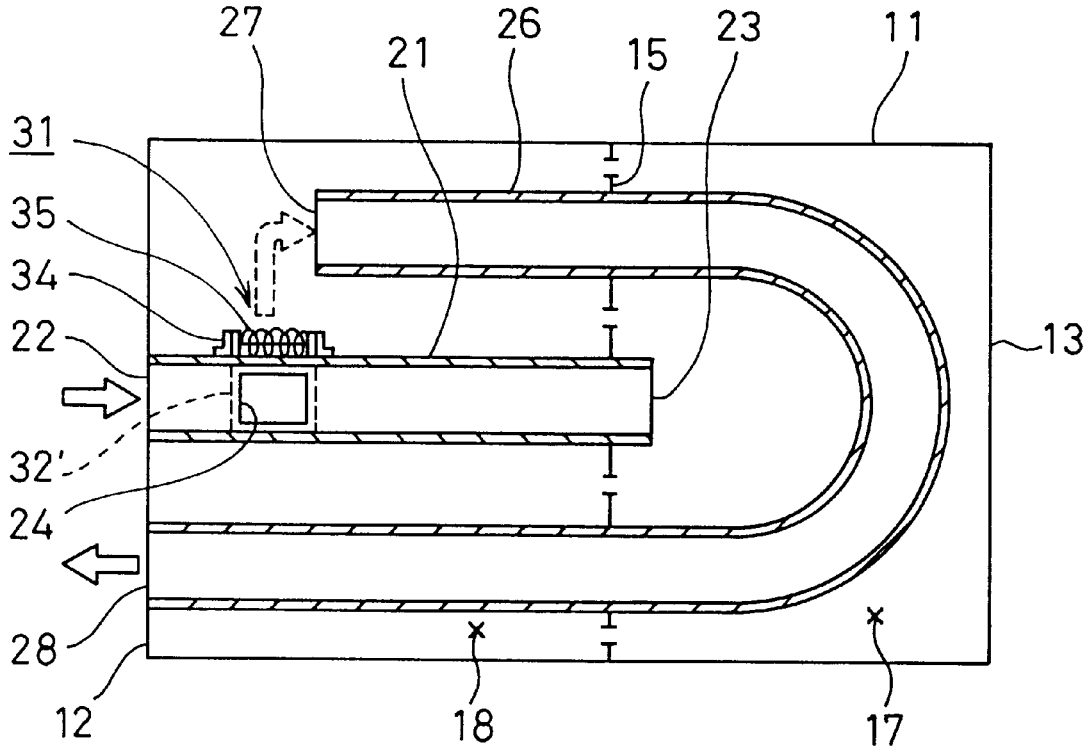
FIG. 7 is a sectional diagrammatic view showing a muffler structure according to. a fourth embodiment.
Figure 8:
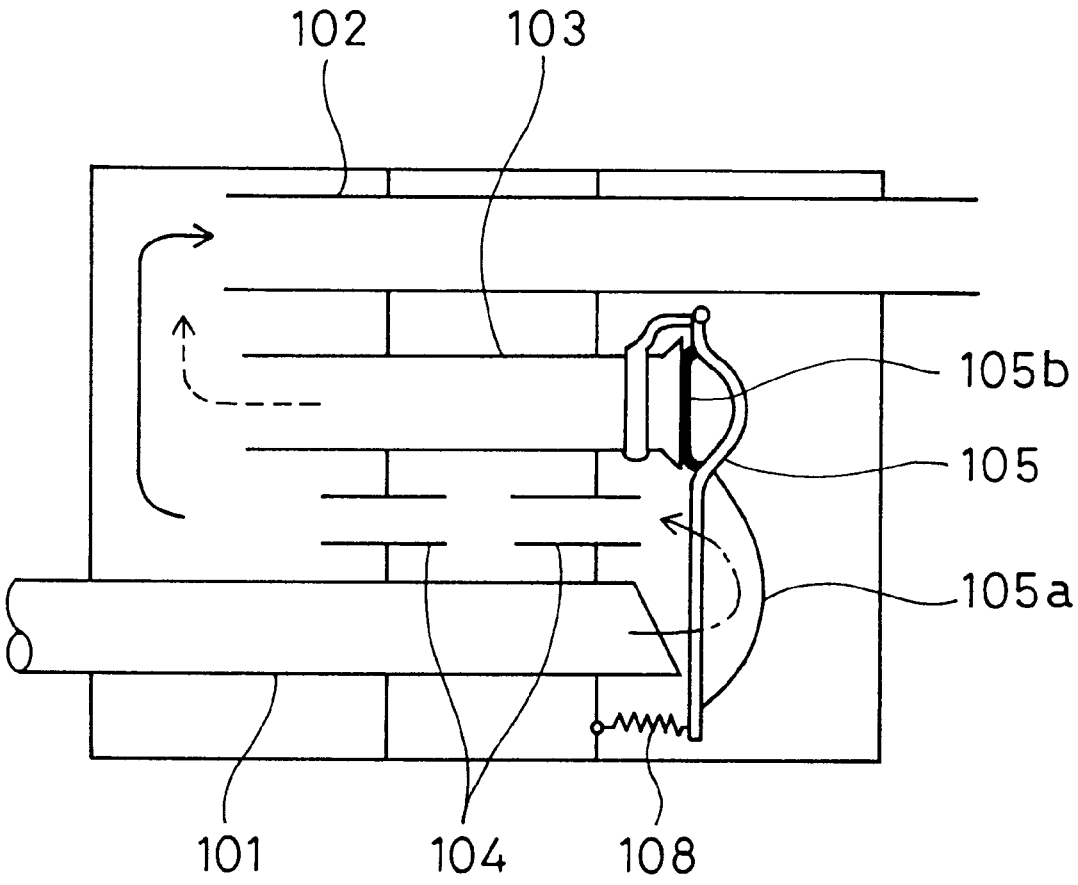
FIG. 8 PRIOR ART
FIG. 8 is an explanatory view of a prior-art muffler.

FIG. 7 is a sectional view of a muffler according to a fourth embodiment. The fourth embodiment is a modification of the first embodiment, and is the same as the first embodiment except that the outlet pipe 26 is not provided with the second side hole 29 and that a valve 32 is configured to close only the first side hole 24 of the inlet pipe 21. Therefore, the same constituting elements are denoted by the same reference numerals, and the description thereof is omitted.

The operation of the muffler of the fourth embodiment will next be described.

When the pressure of the exhaust gas from the engine is low, the valve 32 is closed. Therefore, in the same manner as the first embodiment, the exhaust gas flows into the first chamber 17 via the downstream outlet opening 23 of the inlet pipe 21, shifts to the second chamber 18 via the plurality of punched holes formed in the partition wall 15 from the first chamber 17, is then introduced to the upstream inlet opening 27 of the outlet pipe 26 to pass through the outlet pipe 26, and exhausted to the outside of the muffler via the downstream outlet opening 28.

On the other hand, when the pressure of the exhaust gas from the engine is high, the valve 32 opens the first side hole 24. Then, a short path is formed as a new route as shown by a dashed line arrow and the exhaust gas introduced into the inlet pipe 21 via the upstream inlet opening 22 flows out to the second chamber 18 via the first side hole 24 into the outlet pipe 26 via the upstream inlet opening 27 of the outlet pipe 26, and is exhausted to the outside of the muffler via the downstream outlet opening 28.

In this case, the surface of the valve 32 covering the first side hole 24 is substantially parallel with the flow direction of the exhaust gas. Therefore, even if pulsation is caused in the exhaust gas, the valve 32 does not chatter. Moreover, since the exhaust gas can pass through the short path, increases in the back pressure are effectively suppressed.

Additionally, in the above embodiments, the muffler structure in which a plurality of pipes are arranged in the muffler has been described, but a muffler structure in which one pipe is disposed in a muffler may be provided with a side hole and a valve. Specifically, for example, one pipe inserted through front-end and rear-end walls of the muffler may be provided with side holes in upstream and downstream parts of the pipe, so that the valve opens or closes the side hole on the upstream side in accordance with the pressure of gas passed through the pipe. In this case, chattering can also be prevented. Moreover, when the pressure of the exhaust gas passed through the pipe is raised, the exhaust gas introduced into the pipe can be circulated in a new route. Specifically, the exhaust gas flows out through a space between the pipe and the muffler outer wall via the side hole on the upstream side, and returns into the pipe via the side hole on the downstream side. Therefore, the rising of the back pressure can sufficiently be prevented. Additionally, between the side holes of the upstream and downstream sides, there may be provided a separator having punched holes or an orifice having a reduced pipe diameter.

What is claimed is:

1. A muffler structure in which first and second pipes are arranged in a muffler housing, and exhaust gas passes through the second pipe via the first pipe, comprising:

a first side hole formed in a side surface of said first pipe;

a second side hole formed in a side surface of said second pipe; and a valve biased by a spring to close both said first and second side holes while exposed to a relatively low pressure of the gas in said first pipe and to allow the valve to open against that bias when exposed to a relatively high pressure of gas in said first pipe.

2. The muffler structure according to claim 1 wherein said first side hole is provided in the vicinity of an upstream end of said first pipe, and said second side hole is provided in the vicinity of a downstream end of said second pipe, the side holes being aligned with each other.

3. The muffler structure according to claim 1 wherein said second pipe is an outlet pipe.

4. The muffler structure according to claim 1 wherein said first pipe is an inlet pipe, and said second pipe is an outlet pipe.

5. The muffler structure according to claim 1 wherein the first and second side holes have cushioning material disposed between the valve and side surfaces of the first and second pipes defining the first and second side holes.

6. A muffler structure comprising:

a muffler housing;

at least one pipe disposed within the muffler housing;

a side hole formed in a side surface of the at least one pipe;

a spring; and a valve for covering the side hole formed in the side surface of the at least one pipe; the valve being biased by the spring to normally close the side hole formed in the side surface of the at least one pipe even when the valve is exposed to a relatively low pressure of gas in the at least one pipe, and the valve, and when exposed to a relatively high pressure of gas in the at least one pipe, opening the side hole formed in the side surface of the at least one pipe, against the bias of the spring, to allow a flow of gas through the side hole.

7. A muffler structure comprising:

a muffler housing;

at least one pipe disposed within the muffler housing;

a side hole formed in a side surface of the at least one pipe;

a spring; and a valve for covering the side hole formed in the side surface of the at least one pipe; the valve being biased by the spring to normally close the side hole formed in the side surface of the at least one pipe, and the valve, and when exposed to a sufficient pressure of gas in the at least one pipe, opening the side hole formed in the side surface of the at least one pipe, against the bias of the spring, to allow a flow of gas through the side hole.

* * * * *